United States Patent [19]

Yabe et al.

[11] 4,401,148

[45] Aug. 30, 1983

[54] METHOD FOR AUGMENTATION OF CONDENSATION HEAT TRANSFER BY APPLICATION OF NON-UNIFORM ELECTRIC FIELD

[75] Inventors: Akira Yabe, Yokohama; Yasuo Mori; Kunio Hijikata, both of Tokyo, all of Japan

[73] Assignees: Agency of Industrial Science & Technology; Ministry of International Trade & Industry, both of Tokyo, Japan

[21] Appl. No.: 185,743

[22] Filed: Sep. 10, 1980

[30] Foreign Application Priority Data

Sep. 13, 1979 [JP] Japan ..... 54/117630

[51] Int. Cl.[3] ..... F28P 1/00

[52] U.S. Cl. ..... 165/1; 165/110; 165/DIG. 18

[58] Field of Search ..... 165/110, 109, DIG. 18, 165/1

[56] References Cited

U.S. PATENT DOCUMENTS

| | | | |
|---|---|---|---|
| 2,605,377 | 7/1952 | Kaehni et al. | 165/1 |
| 3,056,587 | 10/1962 | Steigerwald | 165/DIG. 3 |
| 3,868,830 | 3/1975 | Fletcher et al. | 165/111 X |

FOREIGN PATENT DOCUMENTS

| | | | |
|---|---|---|---|
| 53-73655 | 6/1978 | Japan | 165/1 |

*Primary Examiner*—Albert W. Davis, Jr.
*Assistant Examiner*—John F. McNally
*Attorney, Agent, or Firm*—Oblon, Fisher, Spivak, McClelland & Maier

[57] ABSTRACT

In condensation heat transfer, the efficiency of heat transfer at the heat transfer surface is notably augmented by opposing at least one electrode across a prescribed space to the heat transfer surface and applying a high electric potential capable of producing a non-uniform electric field on the heat transfer surface thereby enabling the condensate liquid formed on the heat transfer surface to be attracted by virtue of the electric field to the electrode, formed into a liquid column and removed from the heat transfer surface.

5 Claims, 6 Drawing Figures

METHOD FOR AUGMENTATION OF CONDENSATION HEAT TRANSFER BY APPLICATION OF NON-UNIFORM ELECTRIC FIELD

BACKGROUND OF THE INVENTION

1. Field of the Invention

This invention relates to a method for augmenting condensation heat transfer by directly removing from the surface of heat transfer the condensate liquid film formed on the surface of heat transfer by application of a non-uniform electric field to the field of condensation heat transfer.

2. Description of the Prior Art

The phenomenon of condensation heat transfer widely utilized such as in heat exchangers is a highly advantageous form of heat transfer. In the generation of electric power by effective use of waste heat, for example, when the exchange of heat is carried out between two heat exchangers both falling below 100° C. and differing from each other by about 80° C., since the temperature difference is very small compared with those generally utilized for heat exchange treatment, the heat transfer area must be made large to obtain the same amount of heat transfer as can be obtained with greater temperature differences. Consequently, the proportion of the heat exchanger to the whole power plant is increased and the construction cost of the power plant is proportionally increased. A demand for a method which improves the heat transfer coefficient of the heat transfer surface and permits a size reduction of the heat exchanger has thus been generated.

Generally, in condensation heat transfer, there is the frequently encountered problem that when the condensate liquid film formed on the heat transfer surface gradually grows in thickness, subsequent condensation is gradually diminished by the formed liquid film. Since this problem is overcome by keeping the formed condensate liquid film to a very small thickness at all times, it has been suggested to effect partial decrease in the film thickness as by extending the heat transfer surface or by making use of corona wind. The method which involves extended surfaces, however, has a disadvantage that it entails a troublesome and costly processing step and fails to give sufficient improvement in the heat transfer coeffcient compared with the increase in cost. Furthermore, use of an organic heat medium such as Freon 113 is not sufficiently effective by this method because of its lower surface tension.

The method which makes use of corona wind removes the formed condensate liquid by causing the liquid to move along the heat exchange surface. Since, in the course of such movement of the liquid, the liquid film loses its thickness at some portions and gains its thickness at other portions, this method fails to bring about large improvement in the efficiency of heat transfer.

There have also been suggested methods resorting to mechanical means, such as a method which forcibly removes the condensate liquid film formed on the heat transfer surface by means of a wiper and a method which locally decreases the thickness of the liquid film formed on the heat transfer surface by imparting vibrations to the heat transfer surface. Since the devices used for these methods inevitably necessitate incorporation of mechanically operated components, they require maintenance and suffer a disadvantage that the power required for their operation increases in direct proportion to the area of heat transfer surface. These methods, therefore, prove uneconomical.

In the February 1968 issue of the Journal of Heat Transfer, there is a report on pages 98–102 to the effect that, in a system of two cylinders concentrically disposed so as to embrace an annular space between the outer surface of the inner cylinder and the inner surface of the outer cylinder, wherein a heat medium is supplied to the annular space to cool the outer cylinder and a condensate liquid film is consequently formed on the inner surface of the outer cylinder, application of electric potential to the two concentric cylinders serves to considerably improve the heat transfer coefficient over the level otherwise attained. The reported explanation for this improvement postulates that, upon exposure to the electric potential, the condensate liquid film undulates and sheds itself in the form of invisible droplets into the vapor stream.

SUMMARY OF THE INVENTION

An object of this invention is to provide a method for augmenting the condensation heat transfer in the heat transfer surface by directly removing from the heat transfer surface the condensate liquid film formed on the heat transfer surface thereby improving the heat transfer coefficient to a notable extent.

To accomplish the object described above according to this invention, there is provided a method which comprises applying a high electric potential to an electrode opposed to the surface of condensation heat transfer thereby forming a non-uniform electric field on the condensation heat transfer surface, causing the condensate liquid formed on the heat transfer surface to be attracted by the aforementioned electric field toward the electrode and effecting direct removal of the condensate liquid film from the heat transfer surface.

The method of this invention accomplishes direct removal of the condensate liquid film from the heat transfer surface as described above and, therefore, enables the whole heat transfer surface to be effectively operated at all times. Consequently, it provides notable improvement in the heat transfer coefficient.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF PREFERRED EMBODIMENTS

Generally, electric fields give rise to peculiar phenomena. The inventors have discovered that when a condensate liquid film is formed on a condensation heat transfer surface, application thereto of an electric potential of the order of several thousands of volts by means of a needle electrode opposed to the heat transfer surface causes the condensate liquid to be attracted toward the needle electrode. It has been ascertained that this phenomenon is caused not solely by use of the needle electrode but equally by application of a non-uniform electric field to the site of condensation heat transfer and that, under various test conditions, the condensate liquid is attracted most toward the powerful portion of the non-uniform electric field.

The present invention, therefore, causes the condensate liquid, which has been drawn out of the condensation heat transfer surface in the form of a liquid column toward the electrode in consequence of the aforementioned phenomenon to be collected to a prescribed position through a suitable liquid conduction means utilizing surface tension, gravity, electromagnetic force or pressure difference, for example. Since the condensate liquid film formed on the heat transfer is constantly kept within a small thickness or totally removed, the method of this invention enables the whole condensation heat transfer surface such as in a condenser to be effectively utilized at all times and provides notable improvement in the heat transfer coefficient.

Figure 1:
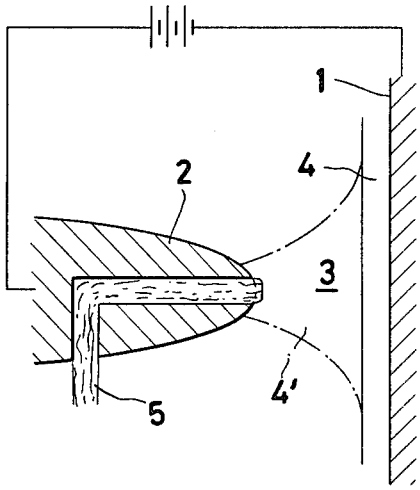
FIG. 1 is an explanatory diagram illustrating the principle underlying the method of this invention for augmenting the condensation heat transfer.

Now, the principle underlying the method of this invention will be described with reference to FIG. 1. An electrode 2 is opposed to a condensation heat transfer surface 1. When a high DC or AC potential of the order of several thousands of volts is applied, a non-uniform electric field is produced in the site of condensation heat transfer 3 having the ambience of vapor as the medium of condensation heat transfer. When the vapor condenses on the cooled condensation heat transfer surface 1 to give rise to a condensate liquid film 4, the non-uniform electric field causes this condensate liquid to be raised from the condensation heat transfer surface and drawn in the form of a liquid column 4' toward the electrode as indicated by the chain line.

Experiments conducted by using Freon 113 as a condensate and applying a DC potential of 7 KV between a needle electrode of a hyperboloidal surface (with a vertical angle of 36°) and a condensation heat transfer surface opposed to each other at a distance of 3 mm have revealed that the condensate liquid film is drawn off the surface and finally attracted to the needle electrode when the distance between the surface of the condensate liquid film and the needle electrode decreases to about 2.5 mm.

Figure 2:
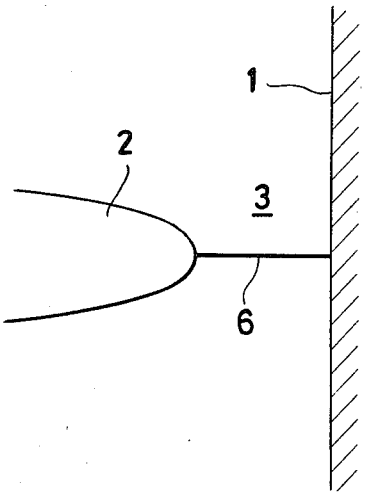
FIG. 2 is an explanatory diagram illustrating a second embodiment of the method of this invention.

The condensate liquid which has been attracted to the electrode 2 must be led further to a prescribed position. In the embodiment of FIG. 1, a wick of absorbent cotton 5 passed through the interior of the electrode 2 and exposed at the tip of the electrode is used for the further conduction of the condensate liquid. When the absorbent cotton is used as described above, since the condensate liquid attracted to the electrode is continuously absorbed by the cotton, it can be led continuously from the other end of the wick of absorbent cotton to a fixed position by virtue of the liquid's own gravity or externally applied forced attraction. In this manner, the formed condensate liquid can be continuously removed from the condensation heat transfer surface. The aforementioned wick of absorbent cotton 5 produces the same effect when it is used as wound on the periphery of the electrode 2. A liquid conduit formed inwardly from the tip of the electrode 2 can be effectively used in the place of the wick of absorbent cotton for discharging the condensate liquid attracted from the condensation heat transfer surface. In this case, the movement of the raised condensate liquid film toward the electrode can be further facilitated by having an electrically insulating thread 6 disposed between the electrode 2 and the condensation heat transfer surface 1 as illustrated in FIG. 2.

The electrode 2 which is opposed to the condensation heat transfer surface 1 fulfills the part of producing the aforementioned non-uniform electric field on the transfer surface. Any of the known electrodes such as a needle electrode, wire electrode and bar electrode can be used insofar as the leading end is rounded so as to preclude otherwise possible occurrence of corona discharge. The electrode to be used herein is not specifically limited by its material. Depending on the shape and according to the intended use, the electrode may be made of platinum, copper, stainless steel, brass or iron.

On the other hand, the condensation heat transfer surface is made of a metal. It is desired to possess a flat, smooth face enough to avoid occurrence of corona discharge between itself and the electrode. This surface may be in any shape insofar as it permits the electrode to be opposed thereto across a specified fine space. For example, flat plates, cylinders and ellipsoides provide good surfaces for the purpose of this invention.

The magnitude of the electric potential applied for causing the attraction of the condensate liquid formed on the condensation heat transfer surface depends on the distance between the electrode and the heat transfer surface. Generally, when this distance is within the range of from 3 to 4 mm, the aforementioned phenomenon of attraction is caused by the voltage of about 15 KV. When the space is on the order of 0.3 to 0.5 mm, however, this phenomenon is caused by application of a few thousands of volts. The phenomenon of the attraction of the condensate liquid due to the application of the potential is not affected at all by the choice between DC and AC of the electricity utilized. This phenomenon permits continuous removal of the condensate liquid from the transfer surface and, therefore, adds notably to the heat transfer coefficient of the transfer surface.

Examples of heat media for which the method of this invention can be effectively utilized include members of the Freon family such as R-11, R-12, R-13, R-21, R-22, R-113 and R-114, high-purity ammonia and purified water. The method of this invention operates particularly effectively with high reproducibility where there are used Freon media which excel in stability. Other heat media can be used on condition that they possess low degrees of electroconductivity.

Instead of causing the condensate liquid formed on the heat transfer surface to be moved from one point to another on the same transfer surface, the method of this invention enables the condensate liquid to be directly removed from the heat transfer surface by attraction to the electrode and then causes it to be further led to a prescribed position as described above. This direct removal of the condensate liquid constitutes one of the characteristic features of this invention. In the embodiment of FIG. 1, a wick 5 such as of absorbent cotton is passed through a hole bored inwardly from the leading tip of the electrode 2. The condensate liquid absorbed via the leading end of the wick 5 is led by virtue of the liquid's own weight to the other end of the wick, there to be collected. When the hole bored inwardly from the leading end of the electrode is provided in the inner wall surface thereof with a multiplicity of fine grooves cut in the axial direction of the hole, the condensate liquid which has been attracted to the electrode can be continuously forwarded in the fine grooves by virtue of the liquid's own weight or the phenomenon of capillary attraction to a fixed position, there to be collected. In this case, the removal of the condensate liquid is accomplished more effectively by causing the condensate liquid to be drawn by a suction pump connected to the discharge end of the hole.

Figure 3:
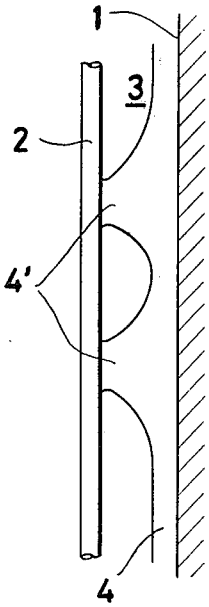
FIG. 3 is an explanatory diagram illustrating a third embodiment of the method of this invention.
Figure 4:
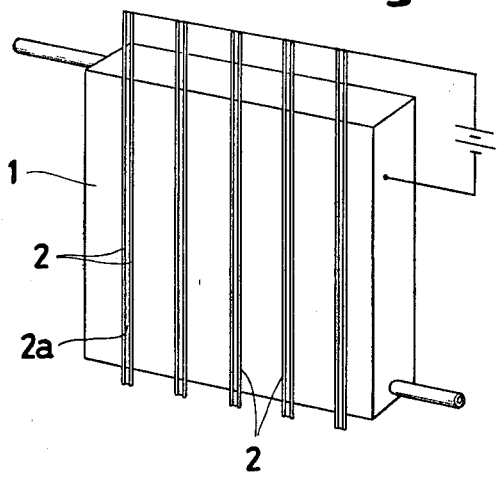
FIG. 4 is a perspective view illustrating a fourth embodiment of the method of this invention.

FIG. 3 depicts an embodiment wherein the condensate liquid formed on the heat transfer surface is attracted by virtue of surface tension coupled with the liquid's own weight to the electrode to effect the removal of the condensate liquid from the heat transfer surface. To be specific, a bar-shaped electrode 2 is longitudinally parallelly opposed to a vertical condensation heat transfer surface 1 so that the condensate liquid is raised at a plurality of points from the heat transfer surface and attracted to the corresponding points of the electrode. The condensate liquid which has arrived on the electrode flows down the electrode. In this manner, the condensate liquid can very easily be removed from the heat transfer surface 1. In this embodiment, when in the place of the one bar electrode opposed to the heat transfer surface, two bar electrodes or wire electrodes 2 separated from each other by a space 2*a* small enough for a liquid to be held therebetween are parallelly opposed to the heat transfer surface 1, the condensate liquid which has been attracted to the pair of electrodes is allowed to flow down the space 2*a* between the electrodes. When a multiplicity of such pairs of electrodes 2 are suitably spaced and opposed across a proper space to the heat transfer surface as illustrated in FIG. 4, removal of the condensate liquid from the whole heat transfer surface can be accomplished with enhanced efficiency. These rod-shaped electrodes 2 may also be opposed to the heat transfer surface in parallel therewith in the horizontal direction or at a slight inclination to the horizontal direction and may have one or both ends thereof provided with suitable liquid-guiding means through which the condensate liquid is collected.

In the case of needle electrodes, the same effect as obtained by using the multiplicity of pairs of wire electrodes can be obtained by having a multiplicity of needle electrodes disposed at intervals such that the non-uniform electric fields generated by the electrodes effectively cover the heat transfer surface.

Figure 5:
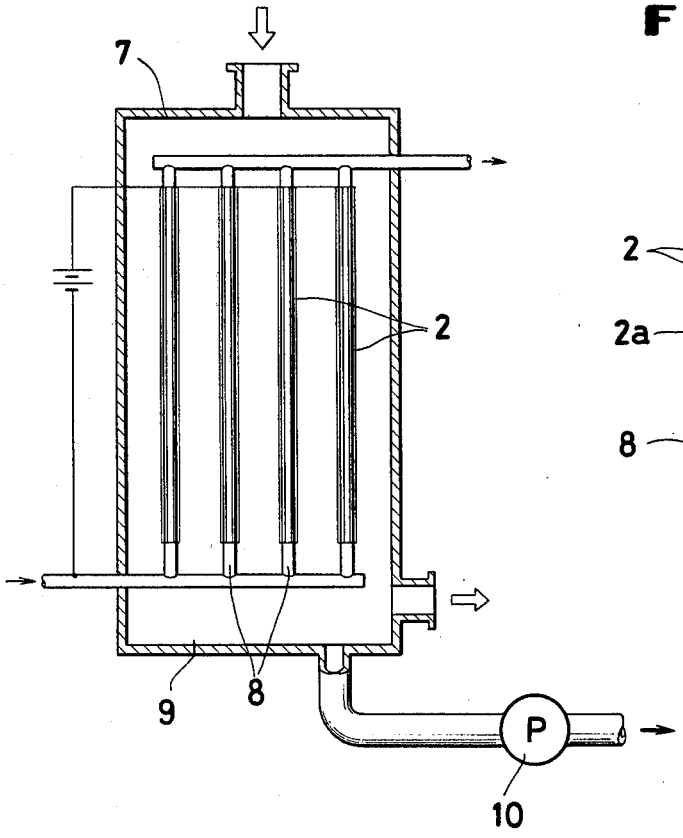
FIG. 5 is an explanatory diagram illustrating application of the method of this invention to a condenser.
Figure 6:
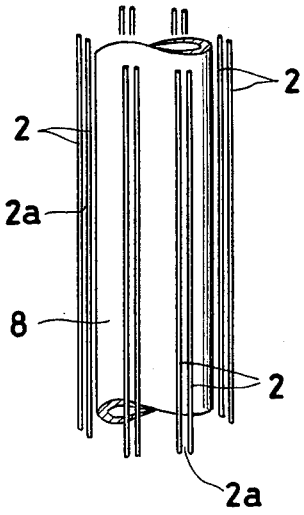
FIG. 6 is an enlarged view of the essential part of the condenser of FIG. 5.

FIG. 5 depicts yet another embodiment of the method of this invention applied to the augmentation of condensation heat transfer in a vertical cylinder type condenser. Within a condenser 7, a multiplicity of vertical condensing tubes 8 for passing a coolant are disposed parallelly to one another. The vapor to be cooled is fed in downwardly from the upper side of the condenser, brought into contact with the condensing tubes 8 and thereafter discharged via the lower side of the condenser. Around each of the condensing tubes 8, a plurality of pairs of wire electrodes 2 are disposed parallelly to the condensing tube and separated by a fixed interval from each other. A high electric potential is applied between the electrodes and the condensing tubes. When the vapor to be cooled touches the condensing tubes 8 and condenses on the surface of the condensing tubes 8, the condensed liquid formed on the surface of the condensing tubes is attracted by the non-uniform electric fields to the electrodes 2. On reaching the electrodes, the condensate liquid flows down the spaces 2*a* between the paired electrodes into a condensate liquid reservoir 9 provided at a lower portion of the condenser. From the reservoir, the condensate liquid is forwarded to a prescribed position by a pump 10.

As described above, the substantial heat transfer coefficient at the heat transfer surface is notably improved by causing the condensate liquid film formed on the heat transfer surface to be completely removed or kept constantly within a small thickness.

As described in detail above, the method of this invention provides direct, forced removal of the condensed liquid from the condensation heat transfer surface by the formation of non-uniform electric field at the site of condensation heat transfer. Consequently, the amount of the condensate liquid which flows down the heat transfer surface is notably decreased and the whole heat transfer surface can be effectively utilized, with the result that the heat transfer coefficient is notably improved. The method, therefore, is suitable for the condensation heat transfer by use of a medium such as Freon which has a small value of electroconductivity and operates effectively with a negligibly small electric power consumption and provides very simple and inexpensive augmentation of condensation heat transfer. When it is applied to heat exchange, it permits notable size reduction in the heat exchanger and large-scale cost reduction in the production of equipment. It can be effectively applied to existing heat exchangers with ease to enhance greatly the efficiency of heat transfer at the heat transfer surface.

Now, the present invention will be described with reference to examples.

EXAMPLE 1

A needle electrode of a hyperboloidal surface (with a vertical angle of 36°) was disposed at a position 43 cm downward from the upper end of a condensation heat transfer surface of a vertical brass plate (10 cm in width and 60 cm in height) and 2.5 mm from the condensation heat transfer surface so that the leading end of the needle electrode faced the condensation heat transfer surface.

Freon 113 vapor of 44.5° C. was brought into contact, under vapor pressure of $8.0\times10^4$ Pa, with the condensation heat transfer surface having the front thereof maintained to a temperature of 38.8° C. by cooling from the rear thereof so as to condense on the condensation heat transfer surface. When a DC potential of 9 KV was applied to the needle electrode, the condensate liquid formed on the condensation heat transfer surface was attracted by the needle electrode to form a liquid column between the condensation heat transfer surface and the needle electrode, guided along the needle electrode and collected in a liquid reservoir. The velocity at which the condensate liquid was collected was about 30 cc/min.

The heat transfer coefficient of the portion of the condensation heat transfer surface in the aforementioned state at a position 45 cm distant downwardly from the upper end thereof was about 1340 $W/m^2\cdot k$.

The aforementioned procedure was repeated for the purpose of the comparison with the aforementioned heat transfer coefficient under the same conditions except that no electric potential was applied to the needle electrode. As a result, the heat transfer coefficient of the portion of the condensation heat transfer surface at the aforementioned position was about 674 $W/m^2 \cdot k$.

Thus, in the method of the present invention, the heat transfer coefficient was improved to about two times the level obtained when no electric potential was applied to the needle electrode.

EXAMPLE 2

A copper wire electrode 8 cm in length and 0.3 mm in diameter was opposed to a condensation heat transfer surface of a vertical brass plate of the same size as in Example 1 in parallel therewith in the horizontal direction at a position 43 cm downward from the upper end of the condensation heat transfer surface and 2 mm from the condensation heat transfer surface. The wire electrode had both ends thereof connected to acrylic support members between which the wire electrode was held in position and through which the condensate liquid which had been attracted by the wire electrode was guided to a liquid reservoir.

In the construction as described above, Freon 113 vapor of 44.5° C. was brought into contact, under vapor pressure of $8.0 \times 10^4$ Pa, with the condensation heat transfer surface maintained at a temperature of 38° C. and a DC potential of 9 KV was applied to the wire electrode. The heat transfer coefficient of the portion of the condensation heat transfer surface at a position 2 cm from the wire electrode was 1880 $W/m^2 \cdot k$ which was about three times as large as the level obtained when no electric potential was applied to the wire electrode.

Obviously, numerous modifications and variations of the present invention are possible in light of the above teachings. It is therefore to be understood that within the scope of the appended claims, the invention may be practiced otherwise as specifically described herein.

What is claimed as new and desired to be secured by Letters Patent of the United States is:

1. A method for augmenting condensation heat transfer which method comprises:

opposing at least one wire electrode across a prescribed space to a condensation heat transfer surface;

applying to said at least one wire electrode an electric potential high enough to form a non-uniform electric field on said condensation heat transfer surface;

causing the condensate liquid occurring on the heat transfer surface to be drawn, by the non-uniform electric field, in the form of a liquid column between the heat transfer surface and the at least one electrode; and causing the condensate liquid attracted to the at least one electrode to be further led to a prescribed position for storage.

2. The method according to claim 1, wherein the space between the heat transfer surface and the at least one electrode is 0.3 to 5.0 mm.

3. The method according to claim 1 or claim 2, wherein said at least one wire electrode further comprises first and second wire electrodes which are separated by a space small enough for the condensate liquid drops attracted by the first and second electrodes to be held therebetween.

4. The method according to claim 1, wherein said at least one wire electrode has a diameter of about 0.3 mm.

5. A method for augmenting condensation heat transfer, which method comprises:

opposing at least one wire electrode across a prescribed space to a condensation heat transfer surface;

applying to said at least one wire electrode an electric potential high enough to form a non-uniform electric field on said condensation heat transfer surface having a ratio of electric field intensity at a portion of the heat transfer electrode opposed to a leading end of the at least one electrode to that at a leading end portion of the at least one electrode falling in the range of 1:8 to 1:10;

causing the condensate liquid occurring on the heat transfer surface to be drawn, by the non-uniform electric field, in the form of a liquid column between the heat transfer surface and the at least one electrode; and causing the condensate liquid attracted to the at least one electrode to be further lead to a prescribed position for storage.

* * * * *